US011326758B1

(12) United States Patent
de Mersseman

(10) Patent No.: US 11,326,758 B1
(45) Date of Patent: May 10, 2022

(54) SPOTLIGHT ILLUMINATION SYSTEM USING OPTICAL ELEMENT

(71) Applicant: Veoneer US, Inc., Southfield, MI (US)

(72) Inventor: Bernard de Mersseman, Andover, MA (US)

(73) Assignee: VEONEER US, INC., Southfield, MI (US)

( * ) Notice: Subject to any disclaimer, the term of this patent is extended or adjusted under 35 U.S.C. 154(b) by 0 days.

(21) Appl. No.: 17/199,687

(22) Filed: Mar. 12, 2021

(51) Int. Cl.
*F21S 41/60* (2018.01)
*F21S 41/25* (2018.01)

(52) U.S. Cl.
CPC ..... *F21S 41/60* (2018.01); *F21S 41/25* (2018.01)

(58) Field of Classification Search
CPC ..... F21V 41/25–27; F21V 41/60; F21V 41/63–635; F21V 41/67; F21V 41/675
See application file for complete search history.

(56) References Cited

U.S. PATENT DOCUMENTS

| | | | |
|---|---|---|---|
| 3,712,985 | A | 1/1973 | Swarner et al. |
| 3,898,656 | A | 8/1975 | Jensen |
| 4,125,864 | A | 11/1978 | Aughton |
| 4,184,154 | A | 1/1980 | Albanese et al. |
| 4,362,361 | A | 12/1982 | Campbell et al. |
| 4,439,766 | A | 3/1984 | Kobayashi et al. |
| 4,765,715 | A | 8/1988 | Matsudaira et al. |
| 4,957,362 | A | 9/1990 | Peterson |
| 5,200,606 | A | 4/1993 | Krasutsky et al. |
| 5,210,586 | A | 5/1993 | Grage et al. |
| 5,274,379 | A | 12/1993 | Carbonneau et al. |
| 5,428,215 | A | 6/1995 | Dubois et al. |
| 5,604,695 | A | 2/1997 | Cantin et al. |
| 5,793,491 | A | 8/1998 | Wangler et al. |
| 5,889,490 | A | 3/1999 | Wachter et al. |
| 5,966,226 | A | 10/1999 | Gerber |
| 6,078,395 | A | 6/2000 | Jourdain et al. |

(Continued)

FOREIGN PATENT DOCUMENTS

| | | |
|---|---|---|
| AT | 509180 B1 | 1/2016 |
| DE | 19757840 C1 | 9/1999 |

(Continued)

OTHER PUBLICATIONS

Communication from EP Application No. 18773034.6 dated Sep. 13, 2021.

(Continued)

*Primary Examiner* — Mariceli Santiago
(74) *Attorney, Agent, or Firm* — Burns & Levinson LLP; Steven M. Mills

(57) ABSTRACT

An illumination system for a vehicle includes a light source to emit light along an optical path and into an environment. A lens is positioned along the optical path and configured to collimate the light to a light beam. An optical element, having a body comprising four sides and a reflective member within the body, is positioned along the optical path and configured to redirect the light beam. The optical element is configured to move around an optical element axis to change a direction the light beam is transmitted into the environment. The illumination system is configured to receive a target position within the environment and move the optical element to fixate the light beam onto the target position.

20 Claims, 15 Drawing Sheets

(56) References Cited

U.S. PATENT DOCUMENTS 6,122,222 A 9/2000 Hossack
6,292,285 B1 9/2001 Wang et al.
6,384,770 B1 5/2002 De Gouy
6,437,854 B2 8/2002 Hahlweg
6,556,282 B2 4/2003 Jamieson et al.
6,559,932 B1 5/2003 Halmos
7,202,941 B2 4/2007 Munro
7,227,116 B2 6/2007 Gleckler
7,272,271 B2 9/2007 Kaplan et al.
7,440,084 B2 10/2008 Kane
7,483,600 B2 1/2009 Achiam et al.
7,489,865 B2 2/2009 Varshneya et al.
7,544,945 B2 6/2009 Tan et al.
7,570,347 B2 8/2009 Ruff et al.
7,675,610 B2 3/2010 Redman et al.
7,832,762 B2 11/2010 Breed
8,044,999 B2 10/2011 Mullen et al.
8,050,863 B2 11/2011 Trepagnier et al.
8,134,637 B2 3/2012 Rossbach et al.
8,223,215 B2 7/2012 Oggier et al.
8,363,511 B2 1/2013 Frank et al.
8,508,723 B2 8/2013 Chang et al.
8,629,975 B1 1/2014 Dierking et al.
8,742,325 B1 6/2014 Droz et al.
8,836,761 B2 9/2014 Wang et al.
8,836,922 B1 9/2014 Pennecot et al.
8,879,050 B2 11/2014 Ko
9,007,569 B2 4/2015 Amzajerdian et al.
9,063,549 B1 6/2015 Pennecot et al.
9,086,273 B1 7/2015 Gruver et al.
9,090,213 B2 7/2015 Lawlor et al.
9,097,646 B1 8/2015 Campbell et al.
9,140,792 B2 9/2015 Zeng
9,157,790 B2 10/2015 Shpunt et al.
9,267,787 B2 2/2016 Shpunt et al.
9,285,477 B1 3/2016 Smith et al.
9,575,162 B2 2/2017 Owechko
9,618,742 B1 4/2017 Droz et al.
9,651,417 B2 5/2017 Shpunt et al.
9,658,322 B2 5/2017 Lewis
9,696,427 B2 7/2017 Wilson et al.
9,711,493 B2 7/2017 Lin
9,753,351 B2 9/2017 Eldada
9,823,351 B2 11/2017 Haslim et al.
9,857,472 B2 1/2018 Mheen et al.
9,869,754 B1 1/2018 Campbell et al.
10,018,725 B2 7/2018 Liu
10,018,726 B2 7/2018 Hall et al.
10,024,655 B2 7/2018 Raguin et al.
10,078,133 B2 9/2018 Dussan
10,088,557 B2 10/2018 Yeun
10,148,060 B2 12/2018 Hong et al.
10,175,360 B2 1/2019 Zweigle et al.
10,183,541 B2 1/2019 Van Den Bossche et al.
10,408,924 B2 9/2019 Mheen
10,411,524 B2 9/2019 Widmer et al.
10,416,292 B2 9/2019 de Mersseman et al.
10,473,767 B2 11/2019 Xiang et al.
10,473,784 B2 11/2019 Puglia
10,473,943 B1 11/2019 Hughes
10,557,923 B2 2/2020 Watnik et al.
10,558,044 B2 2/2020 Pan
10,564,268 B2 2/2020 Turbide et al.
10,578,724 B2 3/2020 Droz et al.
10,678,117 B2 6/2020 Shin et al.
10,775,508 B1 9/2020 Rezk et al.
2001/0052872 A1 12/2001 Hahlweg
2003/0043363 A1 3/2003 Jamieson et al.
2004/0028418 A1 2/2004 Kaplan et al.
2004/0031906 A1 2/2004 Glecker
2004/0135992 A1 7/2004 Munro
2004/0155249 A1 8/2004 Narui et al.
2005/0219506 A1 10/2005 Okuda et al.
2006/0221250 A1 10/2006 Rossbach et al.
2006/0232052 A1 10/2006 Breed
2006/0239312 A1 10/2006 Kewitsch et al.
2007/0140613 A1 6/2007 Achiam et al.
2007/0181810 A1 8/2007 Tan et al.
2007/0211786 A1 9/2007 Shatill
2007/0219720 A1 9/2007 Trepagnier et al.
2008/0088499 A1 4/2008 Bonthron et al.
2008/0095121 A1 4/2008 Shatill
2008/0100510 A1 5/2008 Bonthron
2008/0219584 A1 9/2008 Mullen et al.
2008/0246944 A1 10/2008 Redman et al.
2009/0002680 A1 1/2009 Ruff et al.
2009/0010644 A1 1/2009 Varshneya et al.
2009/0190007 A1 7/2009 Oggier et al.
2009/0251361 A1 10/2009 Bensley
2010/0027602 A1 2/2010 Abshire et al.
2010/0128109 A1 5/2010 Banks
2010/0157280 A1 6/2010 Kusevic et al.
2010/0182874 A1 7/2010 Frank et al.
2012/0075422 A1 3/2012 Wang et al.
2012/0182540 A1 7/2012 Suzuki
2012/0206712 A1 8/2012 Chang et al.
2012/0236379 A1 9/2012 da Silva et al.
2012/0310516 A1 12/2012 Zeng
2012/0310519 A1 12/2012 Lawlor et al.
2013/0088726 A1 4/2013 Goyal et al.
2013/0093584 A1 4/2013 Schumacher
2013/0120760 A1 5/2013 Raguin et al.
2013/0166113 A1 6/2013 Dakin et al.
2013/0206967 A1 8/2013 Shpunt et al.
2013/0207970 A1 8/2013 Shpunt et al.
2013/0222786 A1 8/2013 Hanson et al.
2013/0250276 A1 9/2013 Chang et al.
2014/0036252 A1 2/2014 Amzajerdian et al.
2014/0049609 A1 2/2014 Wilson et al.
2014/0152975 A1 6/2014 Ko
2014/0168631 A1 6/2014 Haslim et al.
2014/0233942 A1 8/2014 Kanter
2014/0313519 A1 10/2014 Shpunt et al.
2015/0009485 A1 1/2015 Mheen et al.
2015/0055117 A1 2/2015 Pennecot et al.
2015/0234308 A1 8/2015 Lim et al.
2015/0260843 A1 9/2015 Lewis
2015/0301162 A1 10/2015 Kim
2015/0371074 A1 12/2015 Lin
2015/0378011 A1 12/2015 Owechko
2016/0047895 A1 2/2016 Dussan
2016/0047896 A1 2/2016 Dussan
2016/0047903 A1 2/2016 Dussan
2016/0138944 A1 5/2016 Lee et al.
2016/0178749 A1 6/2016 Lin et al.
2016/0200161 A1 7/2016 Van Den Bossche et al.
2016/0245902 A1 8/2016 Watnik et al.
2016/0280229 A1 9/2016 Kasahara
2016/0291160 A1 10/2016 Zweigle et al.
2016/0357187 A1 12/2016 Ansari
2016/0363669 A1 12/2016 Liu
2016/0380488 A1 12/2016 Widmer et al.
2017/0023678 A1 1/2017 Pink et al.
2017/0090013 A1 3/2017 Paradie et al.
2017/0102457 A1 4/2017 Li
2017/0199273 A1 7/2017 Morikawa et al.
2017/0219696 A1 8/2017 Hayakawa et al.
2017/0269215 A1 9/2017 Hall et al.
2017/0270381 A1 9/2017 Itoh et al.
2017/0285346 A1 10/2017 Pan
2017/0307736 A1 10/2017 Donovan
2017/0307737 A1 10/2017 Ishikawa et al.
2017/0310948 A1 10/2017 Pei
2017/0329010 A1 11/2017 Warke et al.
2017/0329011 A1 11/2017 Warke et al.
2018/0052378 A1 2/2018 Shin et al.
2018/0113193 A1 4/2018 Huemer
2018/0128903 A1 5/2018 Chang
2018/0143309 A1 5/2018 Pennecot et al.
2018/0180718 A1 6/2018 Lin
2018/0224529 A1 8/2018 Wolf et al.
2018/0241477 A1 8/2018 Turbide et al.
2018/0284237 A1 10/2018 Campbell
2018/0284282 A1 10/2018 Hong et al.

(56) References Cited

U.S. PATENT DOCUMENTS

| | | | | |
|---|---|---|---|---|
| 2018/0284286 | A1 | 10/2018 | Eichenholz | |
| 2018/0306913 | A1 | 10/2018 | Bartels | |
| 2018/0341009 | A1 | 11/2018 | Niclass et al. | |
| 2018/0364334 | A1 | 12/2018 | Xiang et al. | |
| 2018/0372870 | A1 | 12/2018 | Puglia | |
| 2019/0101644 | A1 | 4/2019 | DeMersseman et al. | |
| 2019/0129009 | A1 | 5/2019 | Eichenholz et al. | |
| 2019/0139951 | A1 | 5/2019 | T'Ng et al. | |
| 2019/0146060 | A1 | 5/2019 | Qiu et al. | |
| 2019/0195990 | A1 | 6/2019 | Shand | |
| 2019/0235064 | A1 | 8/2019 | Droz et al. | |
| 2020/0081129 | A1* | 3/2020 | de Mersseman | G02B 26/105 |
| 2020/0088847 | A1 | 3/2020 | DeMersseman et al. | |
| 2020/0341120 | A1* | 10/2020 | Ahn | F21S 41/176 |
| 2020/0341121 | A1* | 10/2020 | Ahn | G01S 17/08 |

FOREIGN PATENT DOCUMENTS

| | | | | |
|---|---|---|---|---|
| DE | 102004033944 | A | 2/2006 | |
| DE | 102006031114 | B4 | 7/2008 | |
| DE | 102008045387 | A1 | 3/2010 | |
| DE | 102014218957 | A1 * | 3/2016 | F21S 41/14 |
| DE | 102015217908 | A1 | 3/2017 | |
| EP | 0112188 | B1 | 6/1987 | |
| EP | 0578129 | A2 | 1/1994 | |
| EP | 2696166 | A3 | 12/2014 | |
| EP | 2824418 | A1 | 1/2015 | |
| EP | 3203259 | A1 | 8/2017 | |
| EP | 3457080 | A1 | 3/2019 | |
| EP | 3147685 | B1 | 1/2020 | |
| WO | 1994019705 | A1 | 9/1994 | |
| WO | 2008008970 | A3 | 1/2008 | |
| WO | 2015014556 | A3 | 2/2015 | |
| WO | WO-2016072483 | A1 * | 5/2016 | F21S 41/16 |
| WO | 2016097409 | A3 | 6/2016 | |
| WO | WO-2016204139 | A1 * | 12/2016 | F21K 9/64 |
| WO | 2019050643 | A1 | 3/2019 | |
| WO | 2019099166 | A1 | 5/2019 | |

OTHER PUBLICATIONS

Kasturi et al., UAV-Bome LiDAR with MEMS Mirror Based Scanning Capability; SPIE Defense and Commercial Sensing Conference 2016, Baltimore, MD; 10 pages, 2016.

Internet URL: https://www.continental-automotive.com/en-gl/Passenger-Cars/Chassis-Safety/Advanced-Driver-Assistance-Systems/Cameras [retrieved on Dec. 20, 2018].

Internet URL: https://www.continental-automotive.com/en-gl/Passenger-Cars/Chassis-Safety/Advanced-Driver-Assistance-Systems/Cameras/Multi-Function-Camera-with-Lidar [retrieved on Dec. 20, 2018].

Hi-Res 3d Flash LIDAR will Supplement Continental's Existing Portfolio for Automated Driving [online], Press Release, Mar. 3, 2016, [retrieved on Dec. 20, 2018]. Retrieved from the Internet URL: https://www.continental-corporation.com/en/press/press-releases/hi-res-3d-flash-lidar-will-supplement-continental-s-existing-portfolio-for-automated-driving-15758.

A milestone for laser sensors in self-driving cars [online], Trade Press, Jul. 11, 2016, [retrieved on Dec. 19, 2018]. Retrieved from the Internet URL: https://www.osram.com/os/press/press-releases/a_milestone_for_laser_sensors_in_self-driving_carsjsp.

Hewlett-Packard Application Note 77-4, Swept-Frequency Group Delay Measurements, Hewlett-Packard Co., September, 7 pages, 1968.

Kravitz et al., High-Resolution Low-Sidelobe Laser Ranging Based on Incoherent Pulse Compression, IEEE Jhotonic,s Technology Letters, vol. 24, No. 23, pp. 2119-2121, 2012.

Journet et al., A Low-Cost Laser Range Finder Based on an FMCW-like Method, IFFF Transactions on Instrumentation and Measurement, vol. 49, No. 4, pp. 840-843, 2000.

Campbell et al., Advanced Sine Wave Modulation of Continuous Wave Laser System for Atmospheric CO2 Differential Absorption Measurements; NASA Langley Research Center, 32 pages, 2018.

Levanon et al., Non-coherent Pulse Compression-Aperiodic and Periodic Waveforms; The Institution of Engineering and Technology, 9 pages, 2015.

Peer et al., Compression Waveforms for Non-Coherent Radar, Tel Aviv University, 6 pages, 2018.

Li, Time-of-Flight Camera—An Introduction, Technical White Paper, SLOA190B, Texas Instruments, 10 pages, 2014.

Pierrottet et al., Linear FMCW Laser Radar for Precision Range and Vector Velocity Measurements, Coherent Applications, Inc., NASA Langley Research Center, 9 pages, 2018.

Kahn, Modulation and Detection Techniques for Optical Communication Systems, Stanford University, Department of Electrical Engineering, 3 pages, 2006.

Niclass et al., Development of Automotive LIDAR, Electronics and Communications in Japan, vol. 98, No. 5, 6 pages, 2015.

Su et al, 2-D FFT and Time-Frequency Analysis Techniques for Multi-Target Recognition of FMCW Radar Signal, Proceedings of the Asia-Pacific Microwave Conference 2011, pp. 1390-1393.

Wojtkiewicz et al., Two-Dimensional Signal Processing in FMCW Radars, Instytut Podstaw Elektroniki Politechnika Warszawska, Warszawa, 6 pages, 2018.

Winkler, Range Doppler Detection for Automotive FMCW Radars, Proceedings of the 4th European Radar Conference, Munich Germany, 4 pages, 2007.

Li et al., Investigation of Beam Steering Performances in Rotation Risley-Prism Scanner, Optics Express, vol. 24, No. 12, 11 pages, 2016.

THORLABS Application Note, Risley Prism Scanner, 33 pages, 2018.

Simpson et al., Intensity-Modulated, Stepped Frequency CW Lidar for Distributed Aerosol and Hard Target Measurements, Applied Optics, vol. 44, No. 33, pp. 7210-7217, 2005.

Skolnik, Introduction to Radar Systems, 3rd Edition, McGraw-Hill, New York, NY 2001, pp. 45-48.

Wang et al., Range-Doppler image processing in linear FMCW Radar and FPGA Based Real-Time Implementation, Journal of Communication and Computer, vol. 6, No. 4, 2009.

International Search Report and Written Opinion for International Application No. PCT/US2018/057727 dated Jan. 28, 2019.

International Search Report and Written Opinion for International Application No. PCT/US2018/052837 dated Jan. 24, 2019.

International Search Report and Written Opinion for International Application No. PCT/US2017/033263 dated Aug. 29, 2017.

International Search Report and Written Opinion for International Application No. PCT/US2018/048869 dated Nov. 22, 2018.

International Search Report and Written Opinion for International Application No. PCT/US2018/051281 dated Nov. 22, 2018.

International Search Report and Written Opinion for International Application No. PCT/US2018/054992 dated Dec. 11, 2018.

International Search Report and Written Opinion for International Application No. PCT/US2018/049038 dated Dec. 12, 2018.

International Search Report and Written Opinion for International Application No. PCT/US2017/033265 dated Sep. 1, 2017.

International Search Report and Written Opinion for International Application No. PCT/US2017/033271 dated Sep. 1, 2017.

Invitation to Pay Additional Fees for International Application No. PCT/US2018/052849 dated Mar. 8, 2019.

http://www.advancedscientificconcepts.com/products/overview.html.

Roncat, Andreas, The Geometry of Airborne Laser Scanning in a Kinematical Framework, Oct. 19, 2016, www.researchgate.net/profile/Andreas_Roncat/publication/310843362_The_Geometry_of Airbome_Laser Scanningin_a_Kinematical_Frameworldinks/5839add708ae3a74b49ea03b1The-Geometry-of-Airbome-Laser-Scanning-in-a-Kinematical-Framework.pdf.

International Search Report and Written Opinion for International Application No. PCT/US2020/039760, dated Sep. 18, 2020.

Church et al., "Evaluation of a steerable 3D laser scanner using a double Risley prism pair," SPIE Paper.

Luhmann, "A historical review on panorama photogrammetry," http://www.researchgate.net/publication/228766550.

(56) References Cited

OTHER PUBLICATIONS

International Search Report and Written Opinion for International Application No. PCT/US2020/064474, dated Apr. 1, 2021.
International Search Report and Written Opinion for International Application No. PCT/US2018/057676, dated Jan. 23, 2019.
International Search Report and Written Opinion for International Application No. PCT/US2018/052849, dated May 3, 2019.
International Search Report and Written Opinion for International Application No. PCT/US2019/046800, dated Nov. 25, 2019.

* cited by examiner

SPOTLIGHT ILLUMINATION SYSTEM USING OPTICAL ELEMENT

FIELD OF THE TECHNOLOGY

The subject disclosure relates to illumination systems and more particularly to illumination systems for vehicles.

BACKGROUND OF THE TECHNOLOGY

Vehicles benefit from having illumination systems to project a beam or several beams of light into an environment to brighten a path of travel or highlight an obstacle. In this regard, automotive illumination systems are installed on the front and rear of vehicles to provide enhanced vision and identification of hazardous articles interfering with the path of travel. Poor lighting conditions at night can present further risks for drivers, who in turn lack a complete clear view of their surroundings. When an article, impediment, or the like suddenly enters the driver's incomplete field of vision, it still may be too late for the driver to readily identify and react accordingly. While headlights have been found to be effective for illuminating the area surrounding the vehicle to some extent, headlights typically illuminate a limited field of view and are restricted in their intensity to avoid adversely affecting other drivers.

SUMMARY OF THE TECHNOLOGY

In light of the needs described above, in at least one aspect, the subject technology relates to an illumination system for a vehicle. The system includes a light source to emit light along an optical path and into an environment. The system includes a lens positioned along the optical path configured to collimate the light to a light beam. The system includes an optical element having a body comprising four sides and a reflective member within the body. The optical element is positioned along the optical path and configured to redirect the light beam. The optical element configured to move around an optical element axis to change a direction the light beam is transmitted into the environment. The system is configured to receive a target position within the environment and move the optical element to fixate the light beam onto the target position.

In some implementations, a rotational position of the optical element around the optical element axis determines an azimuth direction of the light beam. The light source can be affixed to a stage, the stage configured to move orthogonal to the lens to change a direction the light beam is transmitted into the environment. In this regard, the illumination system can be configured to move the light source to fixate the light beam onto the target position. The light source can include a high irradiance white light source. The system can include a detection system configured to determine the target position within the environment.

In some implementations, the reflective member within the body includes glass or an optical polymer. The reflective member can include a reflective surface configured to interface with the light beam. The reflective member can form a diagonal cross section of the optical element such that the reflective member forms an isosceles right triangular prism with two of the four sides.

In at least one aspect, the subject technology relates to a vehicle spotlight. The vehicle spotlight includes a spotlight housing having a transmissive side. The vehicle spotlight includes a light source positioned within the spotlight housing. The light source is configured to emit a light beam along an optical path and into an environment. The vehicle spotlight includes a lens positioned within the spotlight housing between the light source and the transmissive side. The lens is positioned along the optical path. The lens is configured to receive the light beam from the light source and collimate the light. The vehicle spotlight includes an optical element positioned within the spotlight housing between the lens and the transmissive side. The optical element is positioned along the optical path. The optical element has a body comprising four sides and a reflective member within the body. The optical element is configured to move around an optical element axis to change a direction the light beam is transmitted through the transmissive side of the spotlight housing and into the environment. The vehicle spotlight is configured to receive a target position within the environment and move the optical element to fixate the light beam onto the target position.

In some implementations, a rotational position of the optical element around the optical element axis determines an azimuth direction of the light beam. The light source can be affixed to a stage. The stage can be configured to move orthogonal to the lens to change a direction the light beam is transmitted into the environment. The vehicle spotlight can be configured to move the light source to fixate the light beam onto the target position. The vehicle spotlight can include a detection system configured to determine the target position within the environment.

In at least one aspect, the subject technology relates to a method of illuminating a target position within an environment. The method includes receiving, with an illumination system, data related to a target position within the environment. The method includes emitting light, with a light source of the illumination system, along an optical path and into the environment. The method includes collimating, with a lens of the illumination system, the light from the light source into a light beam. The method includes providing, by the illumination system, the light beam to an optical element of the illumination system, the optical element having a body comprising four sides and a reflective member within the body. The method includes actuating the optical element around an optical element axis to change a direction the light beam is transmitted into the environment based on the received target position within the environment.

In some implementations, a rotational position of the optical element around the optical element axis determines an azimuth direction of the light beam. The method can include affixing the light source to a stage, the stage configured to move orthogonal to the lens, and can include moving the stage to shift a position of the light source relative the lens to change a direction the light beam is transmitted into the environment. The light source can include a high irradiance white light source. The method can include generating data related to a target position within the environment using a sensor system including one or more of the following: LIDAR, LADAR, radar, camera, radio, GPS, GNSS, or map.

In some implementations, the reflective member can include a reflective surface configured to interface with the light beam. The reflective member can include glass or an optical polymer. The reflective member can form a diagonal cross section of the optical element such that the reflective member forms an isosceles right triangular prism with two of the four sides.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
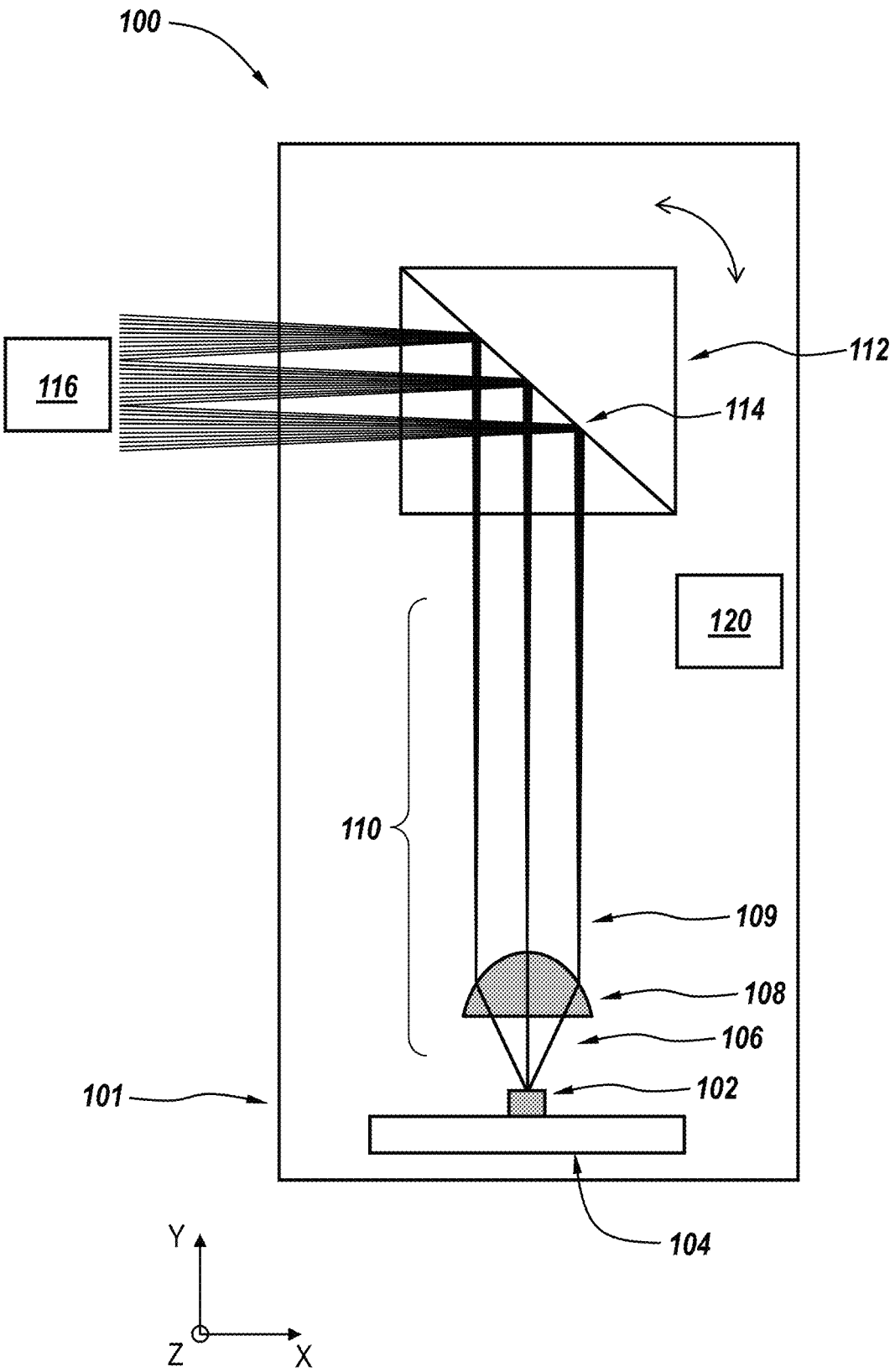
FIG. 1 is an overhead schematic diagram of an illumination system for a vehicle in accordance with the subject technology.

The subject technology overcomes many of the prior art problems associated with illumination systems. In brief summary, the subject technology provides an illumination system utilizing an optical element and reflective member for redirecting light. The advantages, and other features of the systems and methods disclosed herein, will become more readily apparent to those having ordinary skill in the art from the following detailed description of certain preferred embodiments taken in conjunction with the drawings which set forth representative embodiments of the subject technology. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be vertically above).

Referring now to FIG. 1, an illumination system 100 for a vehicle in accordance with the subject technology is shown. The illumination system 100 can be mounted on or within a vehicle requiring illumination (not distinctly shown), such as a car, truck, locomotive, boat, robot, or like vessel. The illumination system 100 includes a housing 101 containing optical components of the system 100. The housing 101 may be a support structure in some implementations. The illumination system 100 employs a light source 102 configured to emit a light 106 along an optical path 110. When activated, the system 100 is designed to undergo an illumination event, illuminating a target position 116 within an environment 118 with light from the light source 102. The target position 116 is illuminated through automatic actuation of the illumination system 100 based on gathered data concerning the environment, described in further detail below.

The target position 116 may include a traveling surface, or a vehicle path of travel, such as: surface impediments; hazardous or nonhazardous articles thereon; curves or turns in the traveling surface; or markers such as crosswalks or lane dividing lines. The target position 116 may include other articles such as vehicles or signs, and retroreflective surfaces thereon such as a license plate, light modules, or traffic signs. The target position 116 may be another object or characteristic of the environment.

The light source 102 can generate light 106 from a single light source (e.g. a single LED or laser source) or from multiple light sources arranged in a column or array. In this regard, multiple sources may contribute along an azimuth direction (contribution of light along the "x-y" plane) or along a vertical direction (contribution of light along the "z" axis) to improve resolution, increase light coverage within the environment, or to enable other functions such as a fog lamp projection. As such, the light source 102 may include, for example, a vertical array of high brightness white, color, or near infra-red LEDs. The light source 102 may include an array of light sources collocated in or near an image plane of the light source 102.

In some cases, the light source 102 may include a single or multiple white laser light sources such as one or more superluminescent diodes, which provide for increased visibility and is noticeable even in daytime lightning. The light source 102 may include a pure crystal of cerium doped yttrium aluminum garnet (Ce:YAG) for light conversion, enabling a small emitting area relative to in-glass or ceramic phosphor. In some implementations, the light source 102 may have an emitting area less than 0.25 millimeters. A smaller emitting area provides for higher efficiency applications and smaller optics and form factor. The light from a Ce:YAG crystal may include a yellow coloring. In other cases, a single or multiple infra-red laser sources may be used in order to provide active illumination to the system for night time operation and to avoid distracting or otherwise effecting the visibility of other drivers.

In some implementations, the light source 102 may be positioned on a stage 104. The stage 104 may be positioned on a rail, track, or other movement enabling system such that the stage 104 is configured to move along an "x" axis, "y" axis, or "z" axis of the illumination system 100. In this regard, the light source 102 may emit light 106 from different angles and thus change a direction that light is transmitted, enabling the illumination system 100 to direct the light to the target position 116 of the surrounding environment.

A collimating lens 108 is positioned along the optical path 110, in between the light source 102 and an optical element 112. The collimating lens 108 includes a curved mirror or lens to collimate the emitted light 106 from the light source 102. In this regard, the collimating lens 108 may reduce the divergence of the light 106 or align the light 106 along the "y" axis direction of the illumination system 100. As such, the collimating lens 108 is positioned along the optical path 110 to collimate light 106 into one or more light beams received by the optical element 112.

While the properties of the optical element 112 are discussed in greater detail below, the optical element 112 is configured to move around an optical element axis to redirect the light beam 109 to a target position 116, such as an object in the surrounding environment, illuminating the object.

The optical element 112 includes a reflective member 114 within a body in the shape of a prism. The optical element 112 can be affixed to rotate centrally around an optical element axis, such as the "z" axis of illumination system 100, to direct the light beam 109 in the azimuth direction (i.e. changing field of view along the "x-y" plane). In this regard, the optical element 112 can rotate in full, 360 degree rotations or can shift or oscillate to direct the light beam 109 to the target position 116 in the environment. Movement of the optical element 112 can be accomplished by coupling the optical element 112 to an actuator, not distinctly shown.

In the arrangement shown, the light source 102, collimating lens 108, and the optical element 112 are arranged in a substantially straight line in the azimuth plane, that is, the "x-y" plane. In some implementations, light source 102, collimating lens 108, and optical element 112 may be positioned in an offset manner, such as to reduce a length of the illumination system 100. In other implementations, one or more reflective lenses (not distinctly shown) may be employed such that light source 102, collimating lens 108, and the optical element 112 can be positioned indiscriminately within illumination system 100.

The system 100 can also include a processing module 120, which can be a processor connected to memory and configured to carry out instructions, the processing module 120 being configured to control the optical element 112 and stage 104 based on the target position 116 in the environment and to store and process any generated data relating to the environment. For example, where a detection system, described in further detail below, identifies a hazard on a roadway, processing module 120 can control the optical element 112 and stage 104 to direct the light beam 109 in the direction of the hazard on the roadway.

Processing module 120 controls the light source 102 intensity (current pulse) through software via a current source driver via a current source driver. In this regard, the intensity is adjusted in real time by the processing module 120. The current adjusted depends on the position or angle of the light beam 106 relative the optical path 110 or depending on the target position 116 in the environment, as defined above, and background illumination.

Figure 2A:
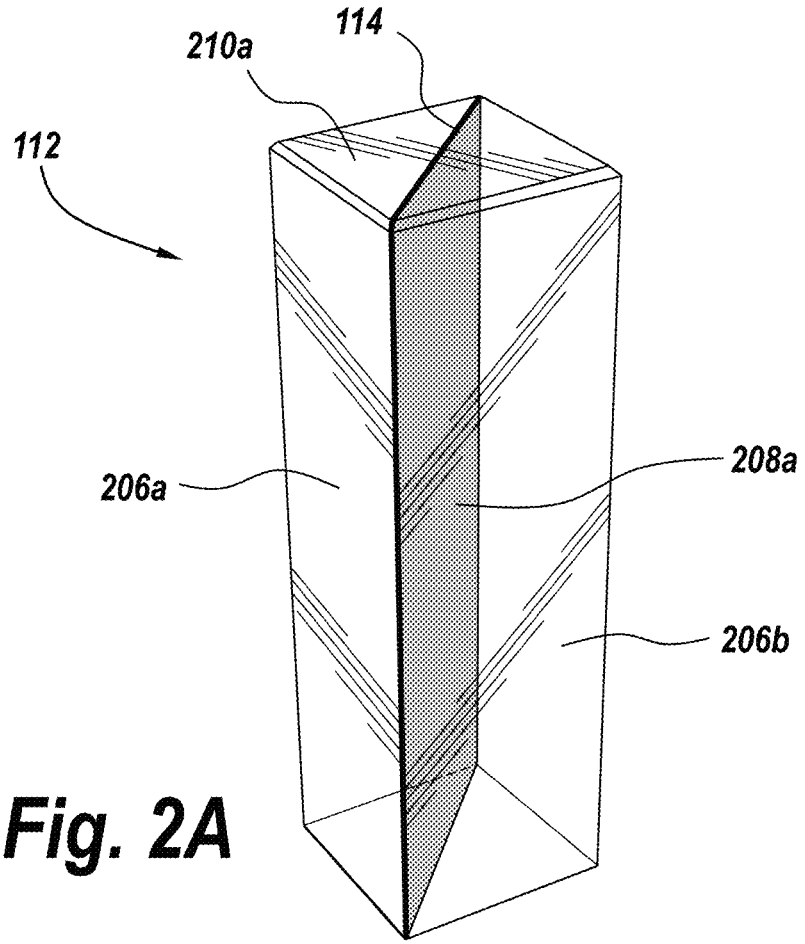
FIG. 2A is a front perspective view of an optical element component for the illumination system of FIG. 1.
Figure 2B:
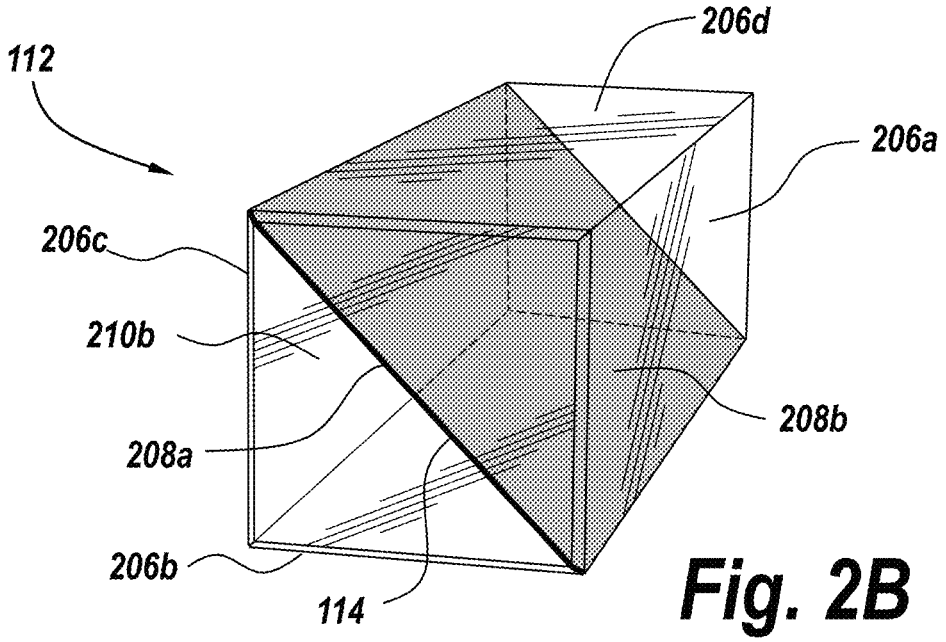
FIG. 2B is a bottom perspective view of the optical element of FIG. 3A.

Referring now to FIGS. 2A-2B, the details of the optical element 112 are shown and described in further detail. The optical element 112 has a body in the shape of a rectangular prism with an exterior defined by four outer faces 206*a*, 206*b*, 206*c*, 206*d* (generally 206) forming the prism sides which extend between the faces 210*a*, 210*b* (generally 210) which form the prism ends. In general, the faces 206 sit at right angles to one another. The outer faces 206 are generally transmissive, allowing light to pass therethrough, and allowing light to pass through the body of the optical element 112, while redirecting the light as discussed in more detail below. Note that while a four sided prism is shown, the prism can include a different number of sides, such as 6, 8, etc., and still be used within the illumination system. In some implementations, the optical element 112 may define a polygonal prism, having fewer or more faces than 6, fewer or more edges than 12, or fewer or more vertices than 8.

A flat rectangular reflective member 114 with opposing reflective surfaces 208*a*, 208*b* forms a diagonal cross section of the optical element 112. The reflective member 114 extends the length of the optical element 112 between the ends 210, running parallel to the outer faces 206. In particular, two of the transmissive faces 206*b*, 206*c* are on a first side 208*a* of the reflective member 114, light passing through those transmissive faces 206*b*, 206*c* interacting with the first side 208*a*. In effect, the sides 206*b*, 206*c* form an isosceles right triangular prism with the first side 208*a* of the reflective member 114 and with the reflective member 114 being the hypotenuse. Similarly, the other two transmissive faces 206*a*, 206*d* are on a second side 208*b* of the reflective member 114, allowing light passing through to interact with the second side 208*b* of the reflective member 114. The transmissive faces 206*a*, 206*d* likewise form an isosceles right triangular prism with the second side 208*b* of the reflective member 114 and with the reflective member 114 being the hypotenuse.

The reflective member 114 may include a glass material or an optical polymer material such as polymethyl methacrylate, polycarbonate, polystyrene, liquid silicon or the like. The outer faces 206 similarly include glass or an optical polymer. In this regard, the optical element 112 is made of a material having a refractive index varying from a medium surrounding the optical element 112. In some implementations, the optical element 112 is made of a solid piece of glass with a high refractive index. In some implementations, the refractive index N is greater than 1.5. As such, internal reflection of light beam 109 may occur at the faces 206, 210 of the optical element 112, described by Snell's law of refraction.

Figure 3A:
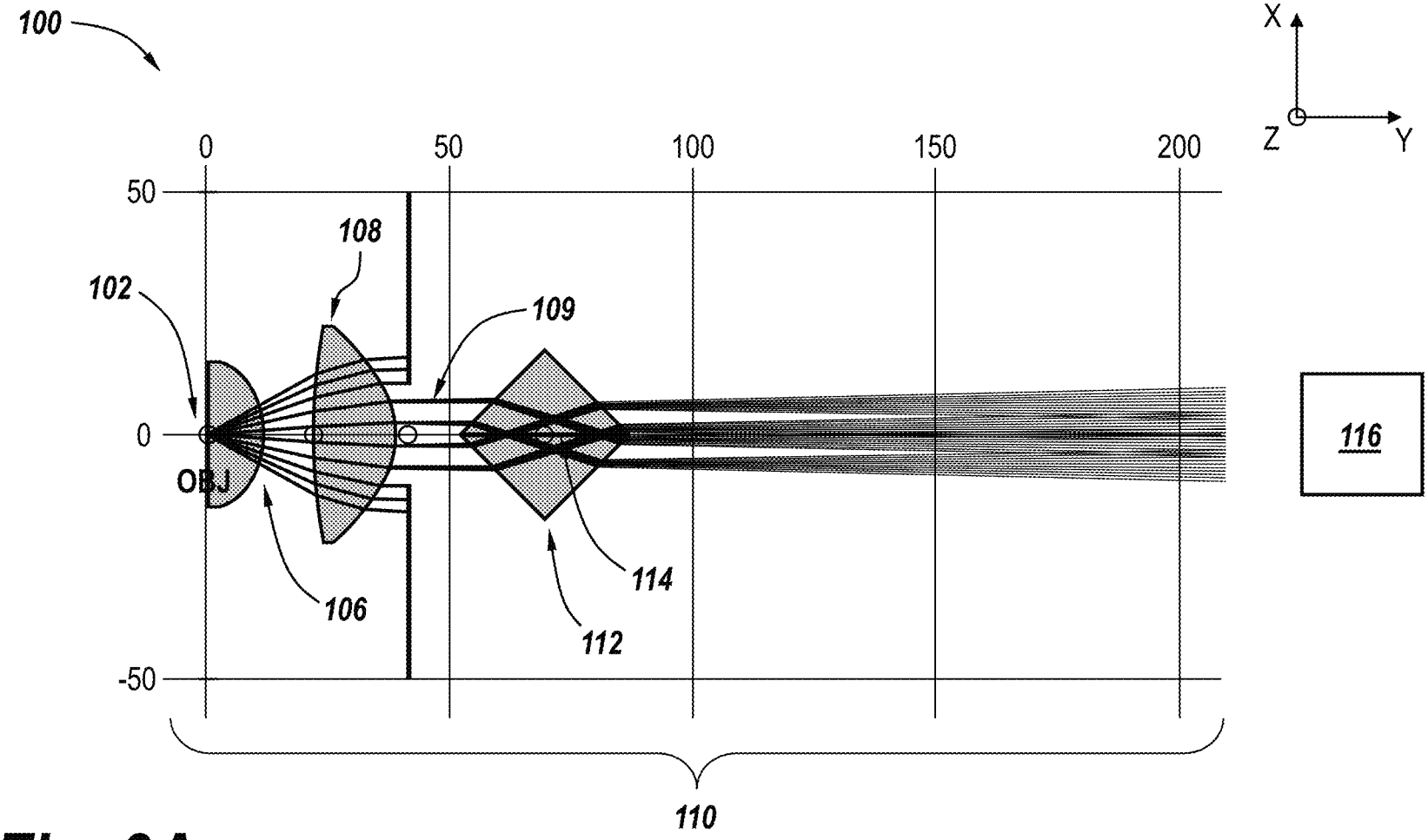
FIG. 3A-3C are overhead block diagrams of the illumination system of FIG. 1, showing optical element positions and corresponding optical paths of light in an azimuth plane.
Figure 3B:
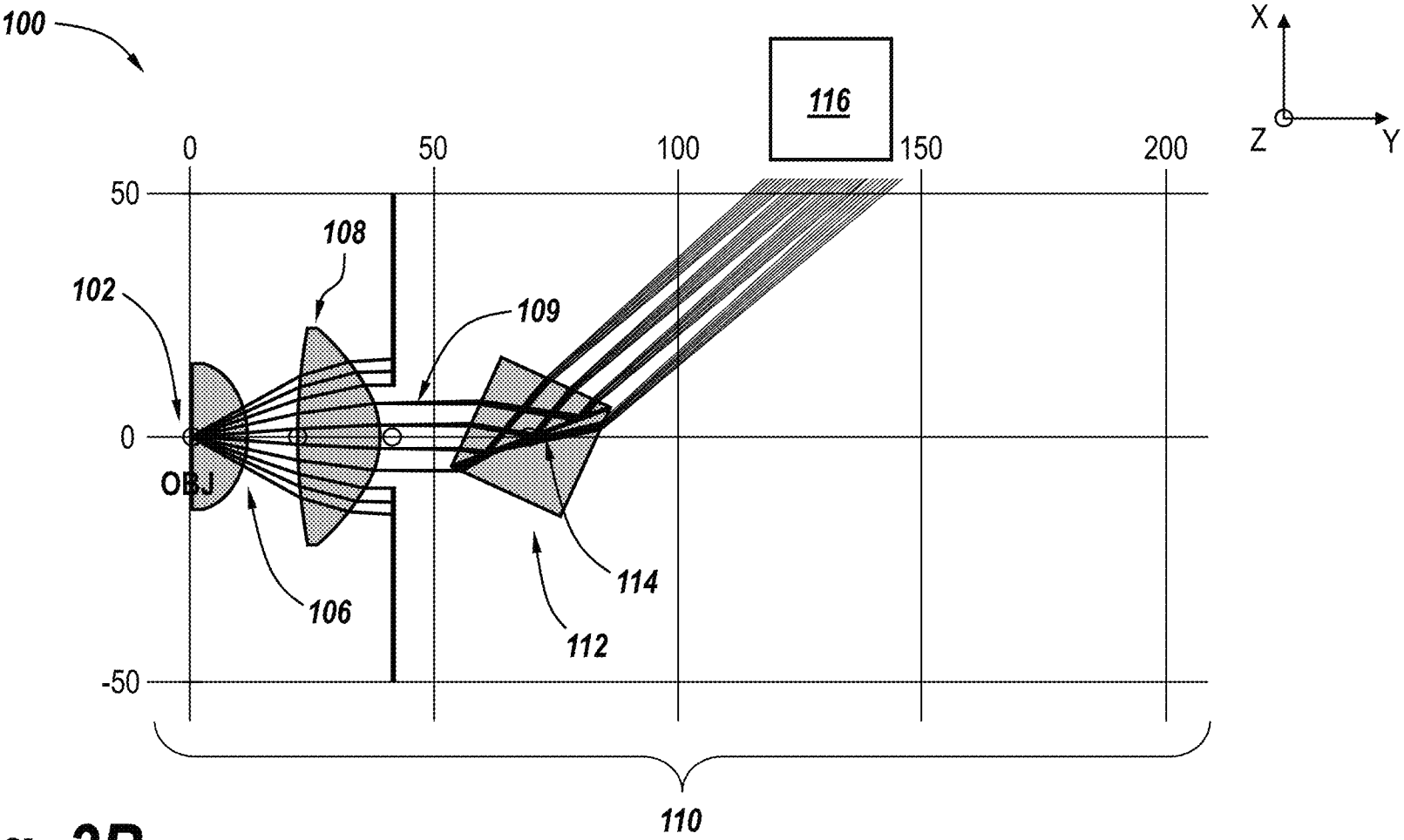
Figure 3C:
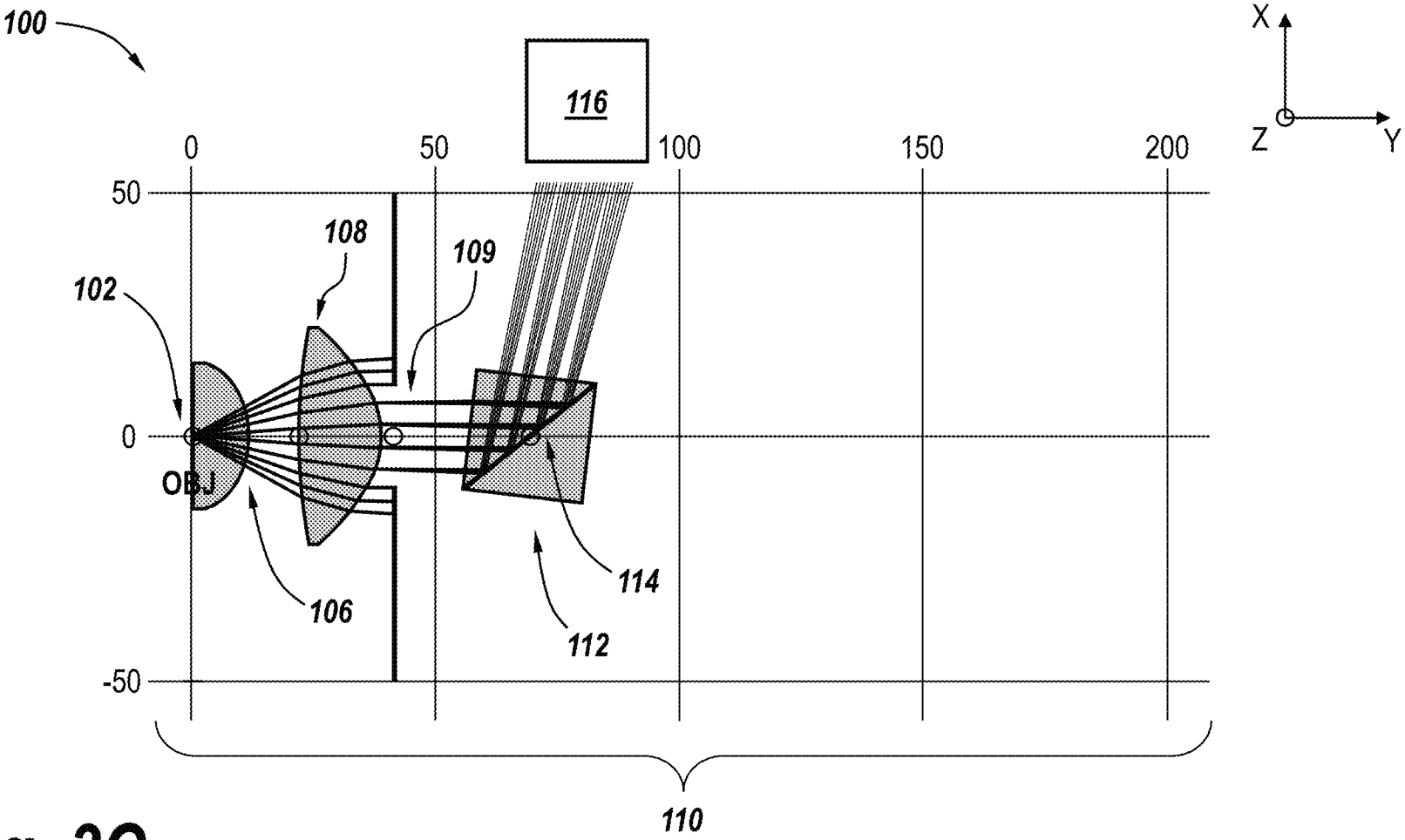

FIGS. 3A-3C, are overhead views of variously directed optical paths by illumination system 100, showing positions of optical element 112 for a spotlight pattern in the azimuth direction. In the arrangement shown, the light source 102, collimating lens 108, and the optical element 112 are arranged in a substantially straight line in the azimuth plane, that is, the "x-y" plane (understanding there might be an offset of some components in other implementations, for example, as shown with respect to reflective lenses 602 in FIG. 6 and FIG. 8).

As mentioned prior, collimating lens 108 receives the light 106 from the light source 102 to collimate the light, such as reducing the divergence of light 106 or aligning the light 106 in the direction of the "y" axis. As such, the collimating lens 108 is positioned along the optical path 110 to direct a collimated light beam 109 to the optical element 112. The configuration of illumination system 100, with an optical path 110 straight along the azimuth plane between the light source 102, collimating lens 108, and optical element 112 allows for rotation of the optical element 112 to provide a large, 270 degree field of view of the environment.

FIG. 3A shows an exemplary position of the optical element 112 rotated along the optical element axis, "z" axis of illumination system 100, such that the reflective member 114 within the optical element 112 is substantially in line with the optical path 110. For explanatory purposes, it is described that the reflective member 114 of the optical element 112 is at an angle of rotation approaching 0 degrees relative the boresight of light source 102. The boresight of the light source 102 is parallel to the "y" axis of illumination system 100 in some implementations. In this regard, the optical path 110 is not substantially altered by the reflective member 114, as the light beam 109 passes through the body of the optical element 112 toward a target position 116. In fact, the body of the optical element 112 helps redirect light around the reflective member 114 so that it does not interfere with the transmission of light into the environment.

FIG. 3B shows a second example position of the optical element 112 rotated along the "z" axis such that the reflective member 114 within the optical element 112 intersects the light beam 109 at an angle. FIG. 3B shows the reflective member 114 rotated counterclockwise at an angle of rotation approaching 25 degrees with respect to the boresight of the light source 102. This allows for the spotlight field of view to reach 45 degrees relative the boresight of light source 102 or the "y" axis of illumination system 100, as the light beam 109 leaving collimating lens 108 reflects from the angled surface of the reflective member 114.

FIG. 3C shows a third example position of the optical element 112 rotated along the "z" axis such that the reflective member 114 within the optical element 112 intersects the light beam 109 at an angle. In FIG. 3C, the reflective member 114 is rotated counterclockwise at an angle of rotation approaching 45 degrees relative the boresight of light source 102. This allows for the spotlight field of view to reach 85 degrees relative the boresight of light source 102 or the "y" axis of illumination system 100, as light leaving collimating lens 108 reflects from the angled surface of the reflective member 114.

In other implementations, the reflective member 114 may shift counterclockwise from the positon shown in FIG. 3A to an angle approaching −45 degrees relative the boresight of the light source 102, opposite the position of reflective member 114 shown in FIG. 3C. In this regard, the reflective member 114 may reflect light from the illumination system 100 to the other side of the vehicle as compared to FIGS. 3B and 3C. This allows for the spotlight field of view to reach −85 degrees with respect to the boresight of the light source 102 and the "y" axis of illumination system 110, as light leaving collimating lens 108 reflects from the angled surface of the reflective member 114. Note that while a greater field of view is achievable by the components of the system 100, the components themselves may start to block the field of view of the system 100 at spotlight field of view angles such as 90 degrees with respect to the boresight of the light source 102. Though, a 270 degree field of view in the azimuth direction may occur as the optical element 112 rotates between positions.

Figure 4A:
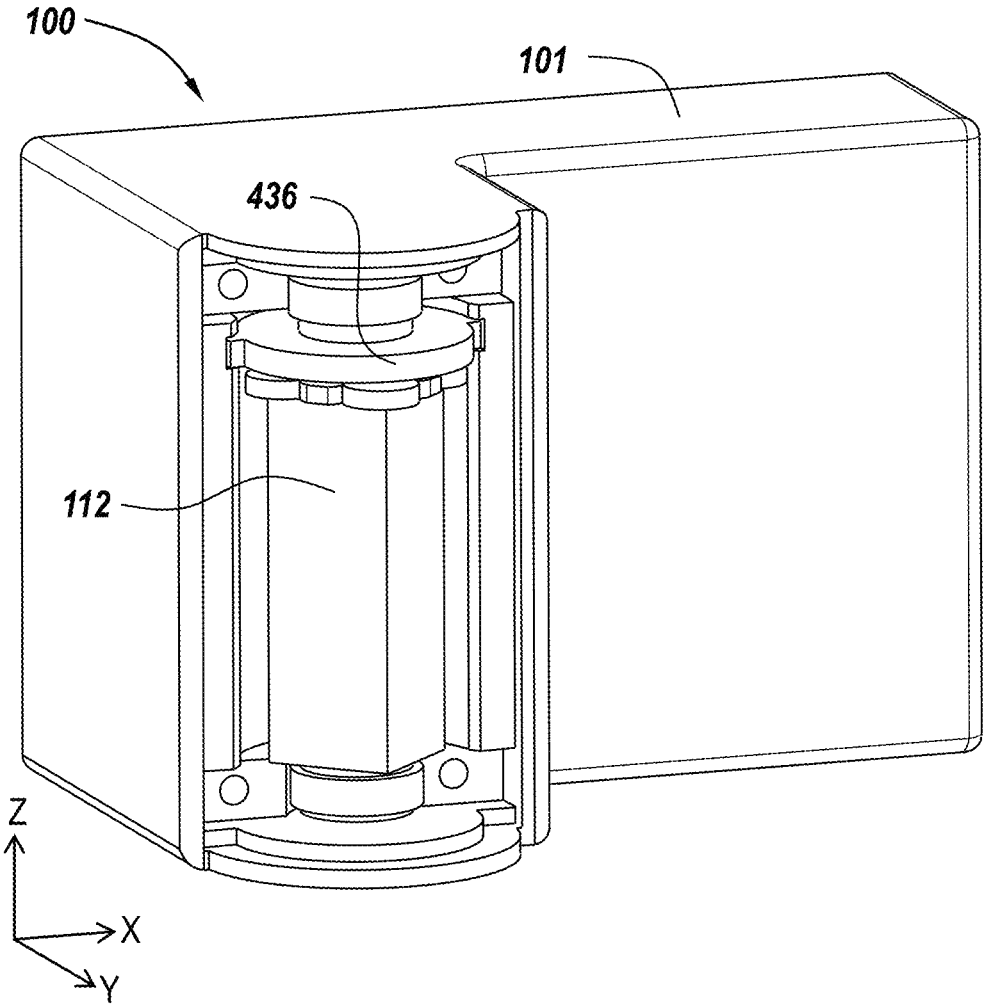
FIG. 4A-4B are front perspective views of an illumination system for a vehicle in accordance with the subject technology.
Figure 4B:
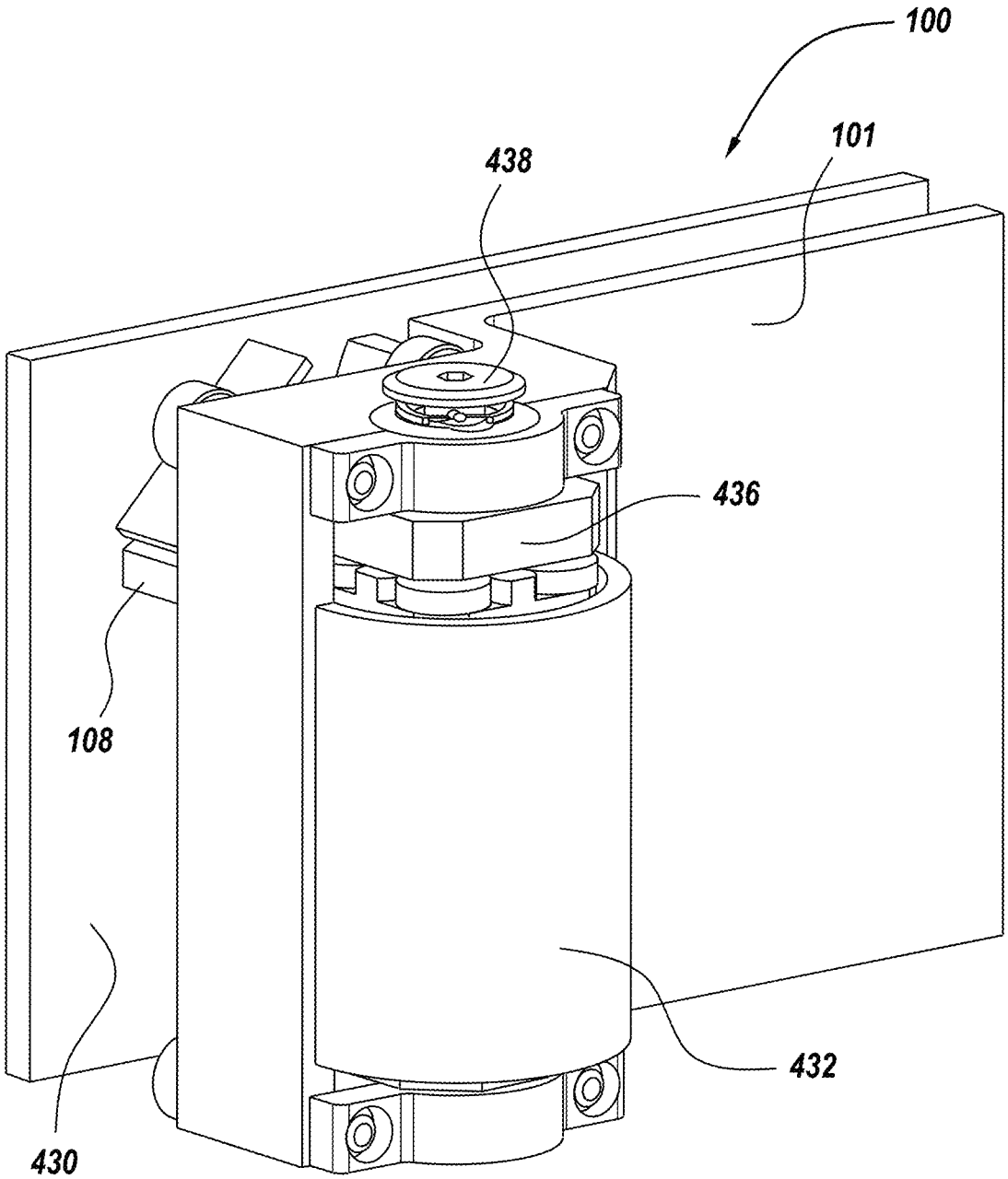

Referring now to FIGS. 4A-4B, the system 100 is shown from a front perspective view, isolated from a vehicle. FIG. 4B is similar to FIG. 4A except that a printed circuit board 430 and glass housing 432 are shown in FIG. 4B and omitted from FIG. 4A for simplicity. A housing 101 is shown upon which the other components of illumination systems can be affixed or encapsulated within. Note, other structural mechanisms attaching the components to the housing 101 are omitted for ease of reference. The housing 101 also serves to shield internal components of the system 400. The printed circuited board 430 is located behind the housing 101 and can include circuitry or the like for carrying out the control and processing functions of the illumination system 100. The protective glass housing 432 surrounds the optical element 112 and collimating lens 108, connecting to the housing 101 to form a secure covering. The protective glass housing 432, also referred to herein as a transmissive face, is configured to allow light to travel therethrough. In this regard, the light travels along an optical path 110, within an interior of the spotlight housing 101, through the transmissive face, and to a target position 116 in a surrounding environment.

An actuator 436 may be affixed to the optical element 112 to cause it to oscillate or rotate around the vertical axis, changing the face 206 and reflective surface 208 interfacing with the emitted light beams 109 to change a direction of the optical path 110 of the illumination system 100 in the azimuth direction. The actuator 436 can be, for example, a brushless motor, a step motor or a voice coil actuator coupled to the housing 101. The optical element 112 can then be connected to the housing 101 via coupling to a bearing or bushing 438.

Referring back to FIG. 1, in other embodiments, actuator 436 may be affixed to the optical element 112 to cause it to move along the "x", "y", or "z" axis of illumination system 100 to change a direction of the optical path 110. As the emitted light passes through the moving optical element 112, the reflective member 114 partially or completely reflects light which contacts its surface. As mentioned prior, the optical element 112 may also be rotated to a position by the actuator 436 in order to target an object in the surrounding environment with the light beam from the spotlight, illuminating the object.

Figure 5A:
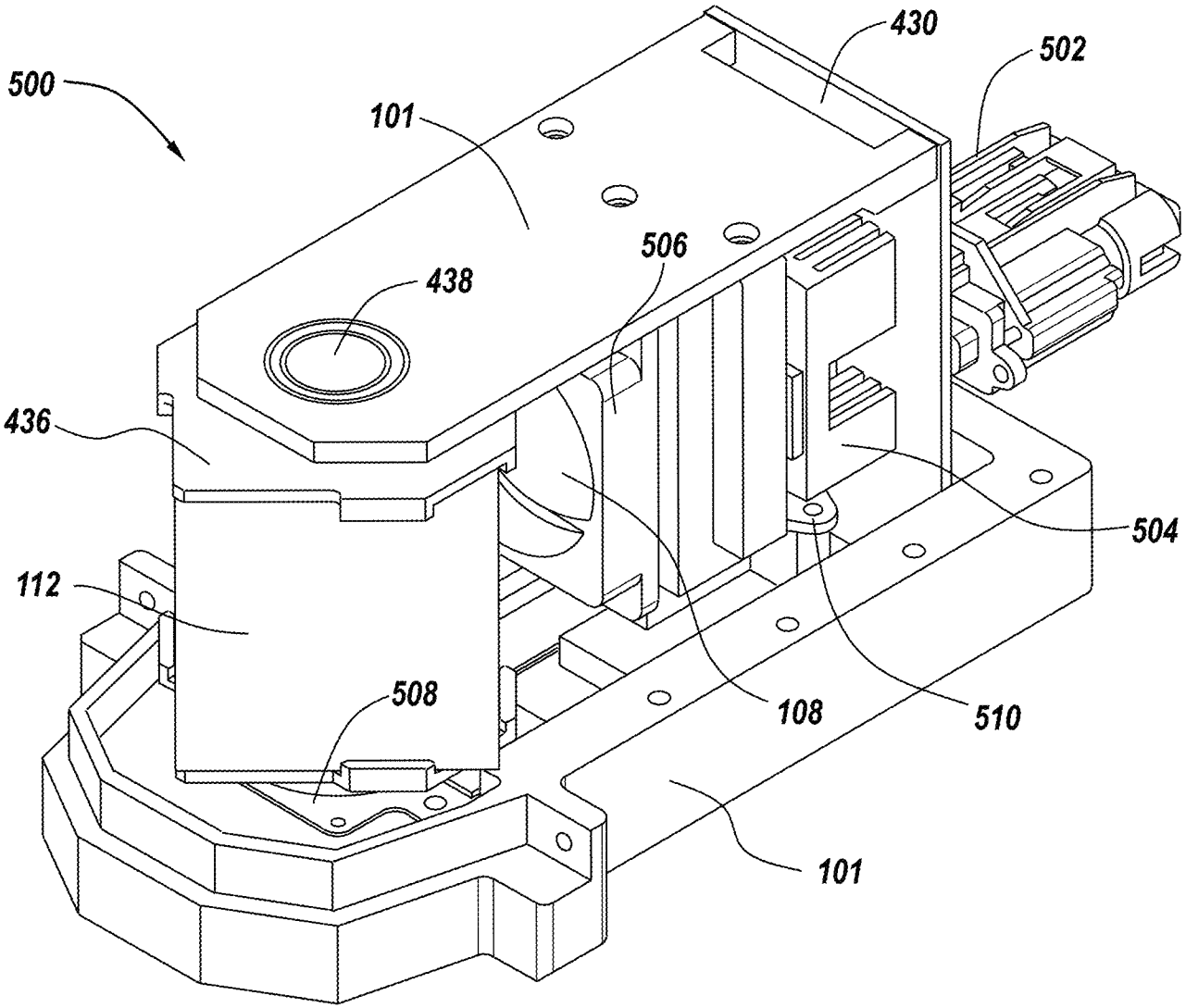
FIGS. 5A-5C are side schematic diagrams of an illumination system for a vehicle in accordance with the subject technology
Figure 5B:
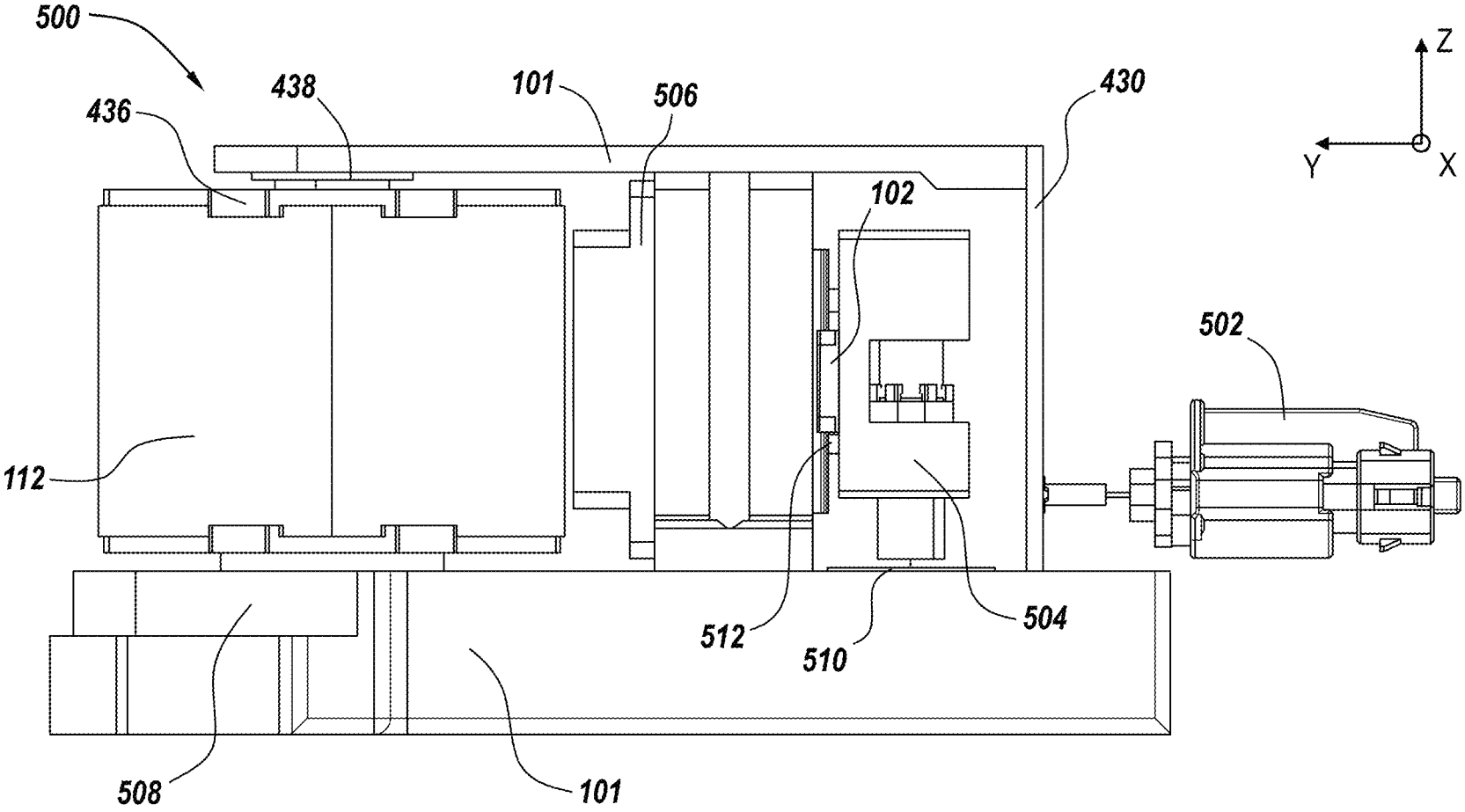
Figure 5C:
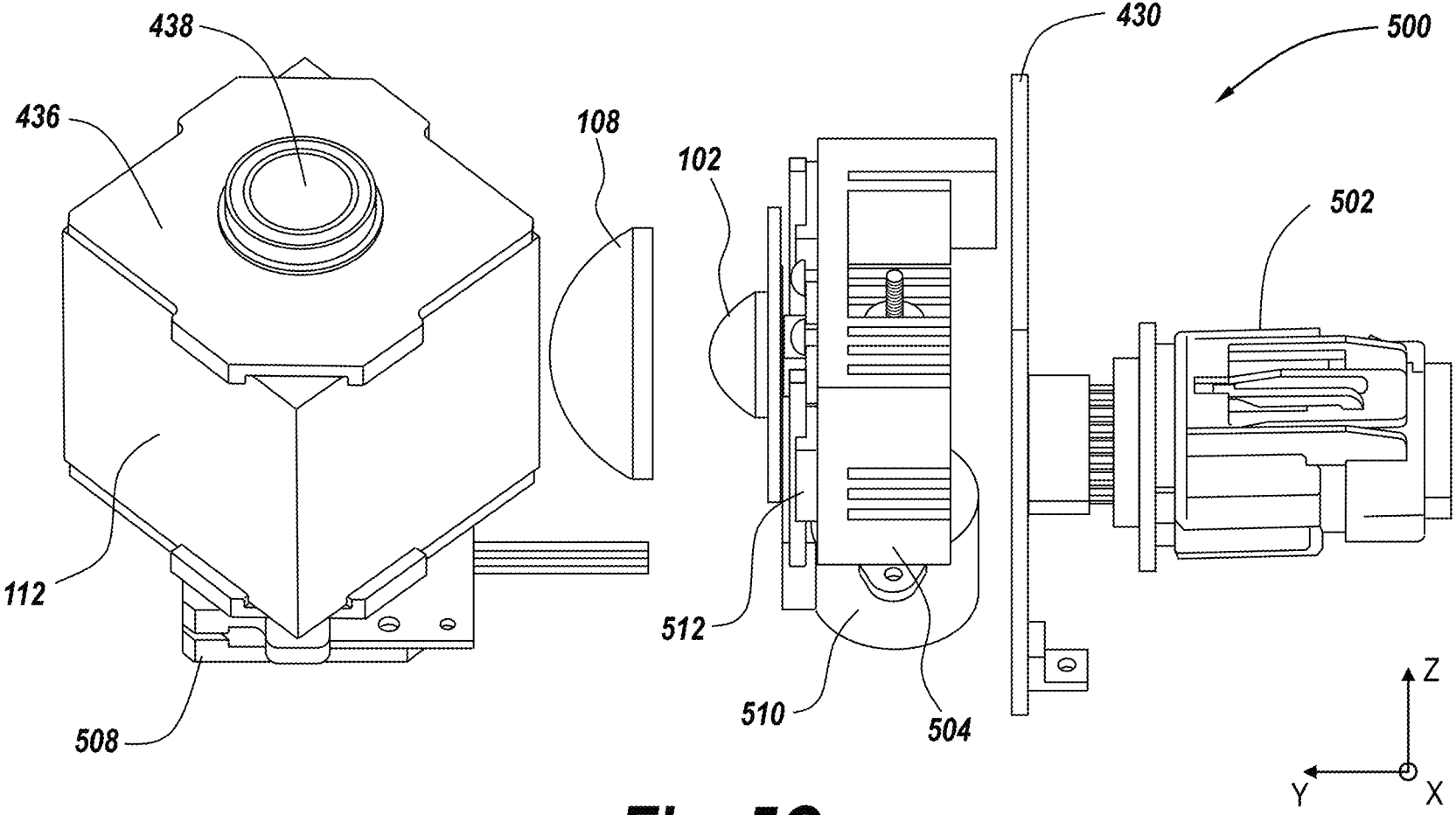

Referring now to FIGS. 5A-5C, an illumination system 500 is shown from several perspective views. It should be understood that the components of the illumination system 500 can function similarly to those of the other illumination systems herein, except as otherwise shown and described herein. Example illumination system 500 has a light source 102 held in place by a mount 504, and a collimating lens 108 also held in place by a mount 506. The mount 504 for the light source 102 includes a flex cable to connect to the printed circuited board 430. In this regard, a power and/or data connector 502 may transmit power, data, or both to the printed circuited board 430 and subsequently to the light source 102.

The light source 102 is positioned on a rail system 512 relative the mount 504 such that the light source 102 can move along an "x", "y", or "z" axis of illumination system 500. The mount 504 is positioned on a step motor 510 such that light source 102 can move relative the "z" axis of illumination system 500, or adjust elevation. Similarly, the optical element 112 is positioned on a step motor 508 such that the optical element 112 can move relative the "z" axis of illumination system 500, or adjust a vertical elevation.

Figure 6:
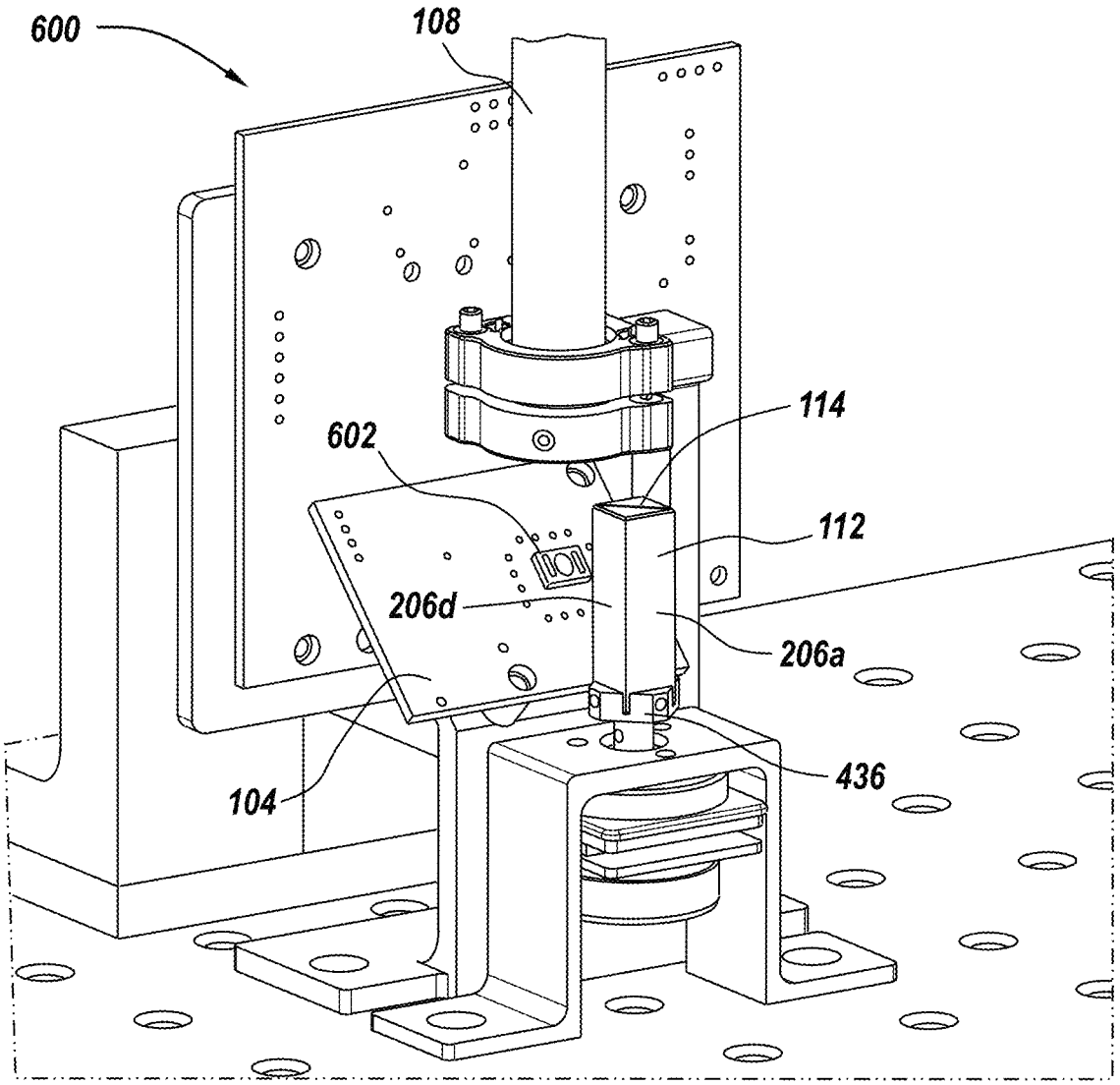
FIG. 6 is a front perspective view of components of an illumination system in accordance with the subject technology

Referring now to FIG. 6, a front perspective view of components of illumination system 600 in accordance with the subject technology is shown. It should be understood that the components of the illumination system 600 can function similarly to those of the other illumination systems herein, except as otherwise shown and described herein. FIG. 6 shows example optics wherein a reflective mirror 602 is employed between the collimating lens 108 and the optical element 112. Reflective mirror 602 redirects the light collimated by lens 108 to the optical element 112. In this regard, reflective mirror 602 and the optical element 112 are positioned in alignment with respect to the azimuth plane (although not necessarily at a shared elevation). In this implementation, the illumination system 600 may providing a compact optical path with components in closer proximity such that the components fit into a spotlight housing 101, while still allowing for a spotlight field-of-view in the azimuth and elevation directions. As with other detection systems shown and described herein, after reflecting from the reflective mirror 602, which can oscillate, rotate, or move along a stage 104 to change the field of view of the system in the elevation direction, the light beams interact with the optical element 112 before entering the surrounding environment.

Figure 7A:
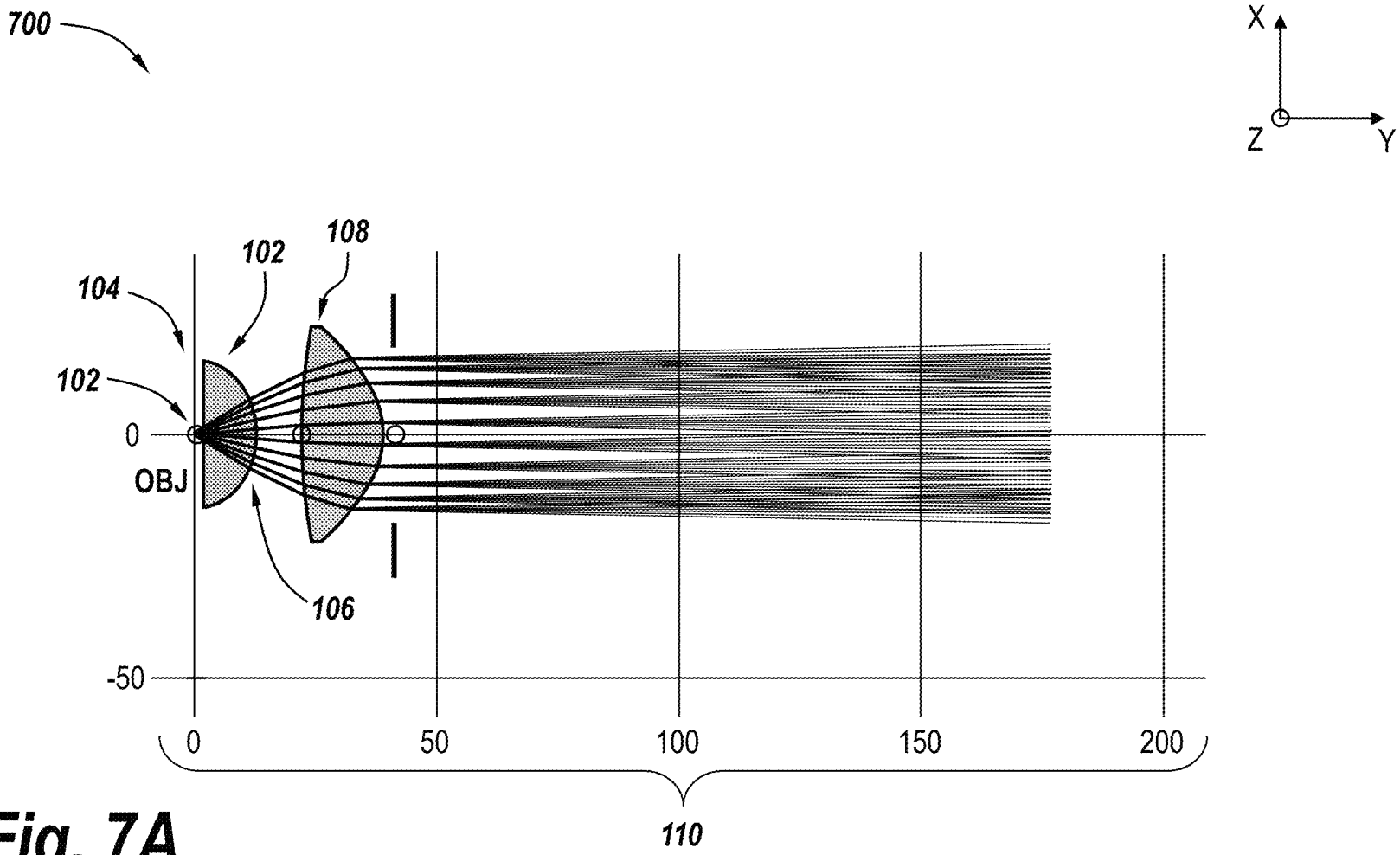
FIGS. 7A-7B are overhead block diagrams of an example illumination system where a spotlight field-of-view is directed in a vertical direction and an azimuth plane.
Figure 7B:
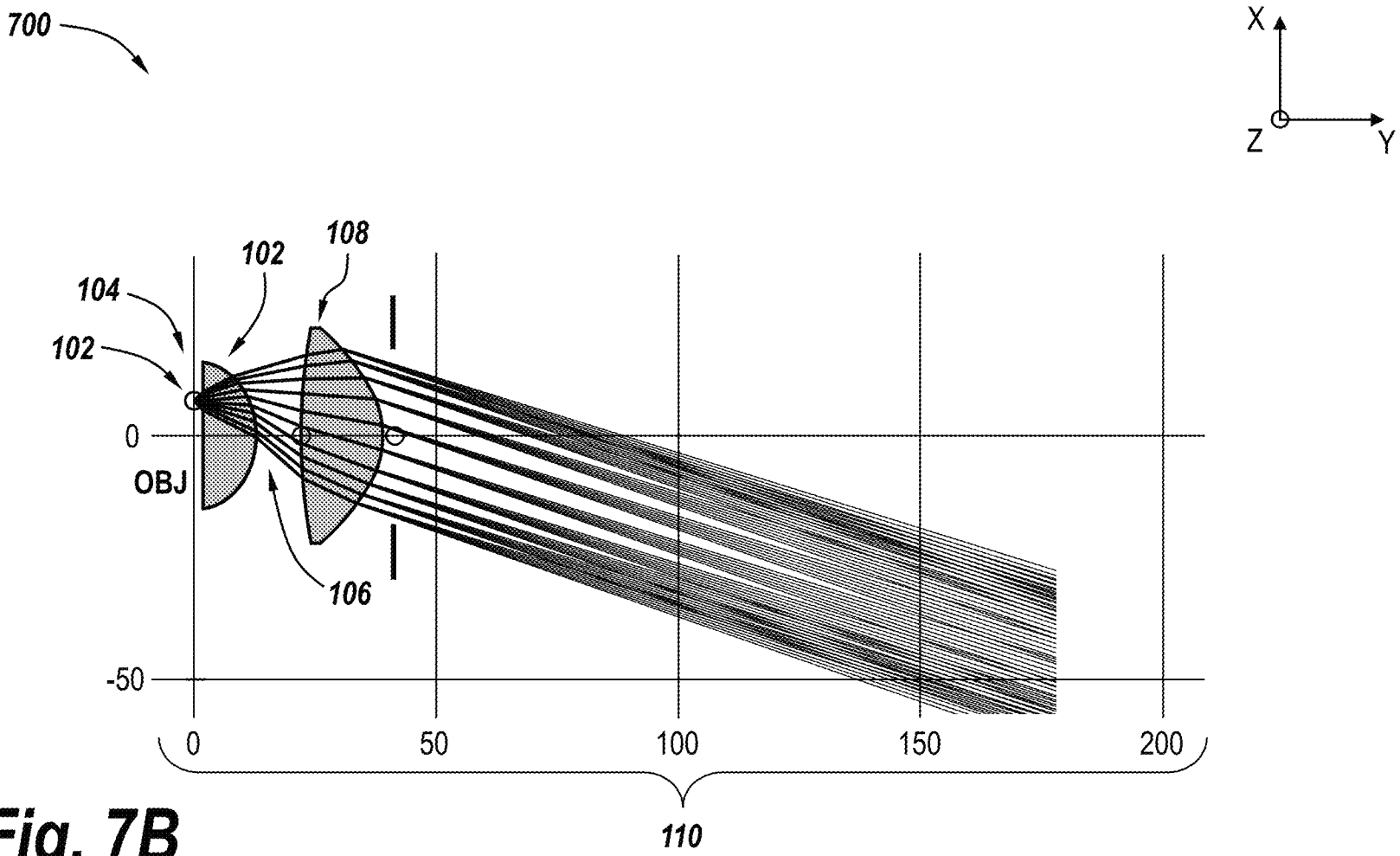

FIGS. 7A-7B are overhead views of optical paths by illumination system 700, showing example implementations of a spotlight field of view in a vertical and horizontal direction. It should be understood that the components of the illumination system 700 can function similarly to those of the other illumination systems herein, except as otherwise shown and described herein. As mentioned prior, illumination systems herein may include a stage 104 on which a light source 102 of the spotlight is affixed to. The stage 104 may be positioned on a rail, track, or other movement enabling system such that the stage 104 is configured to move along an "x" axis, "y" axis, or "z" axis relative the collimating lens 108. In this regard, the light source 102 may emit light 106 along optical path 110, the light arriving at the collimating lens 108 at an angle. In other implementations, collimating lens 108 or optical element 112 may be actuated to move along a stage 104 in an "x" axis, "y" axis, or "z" axis relative the light source 102. In this regard, the light source 102 may emit light 106 along optical path 110, the light arriving into the environment at an angle, enabling position targeting. In other implementations, the light source 102, the collimating lens 108, the optical element 112, or any combination of the light source 102, the collimating lens 108, or the optical element 112 may be actuated with stage 104, or several stages positioned in illumination system 700, in an "x" axis, "y" axis, or "z" axis direction of the illumination system 700 such that the light arrives into the environment at an angle, enabling position targeting.

Figure 8:
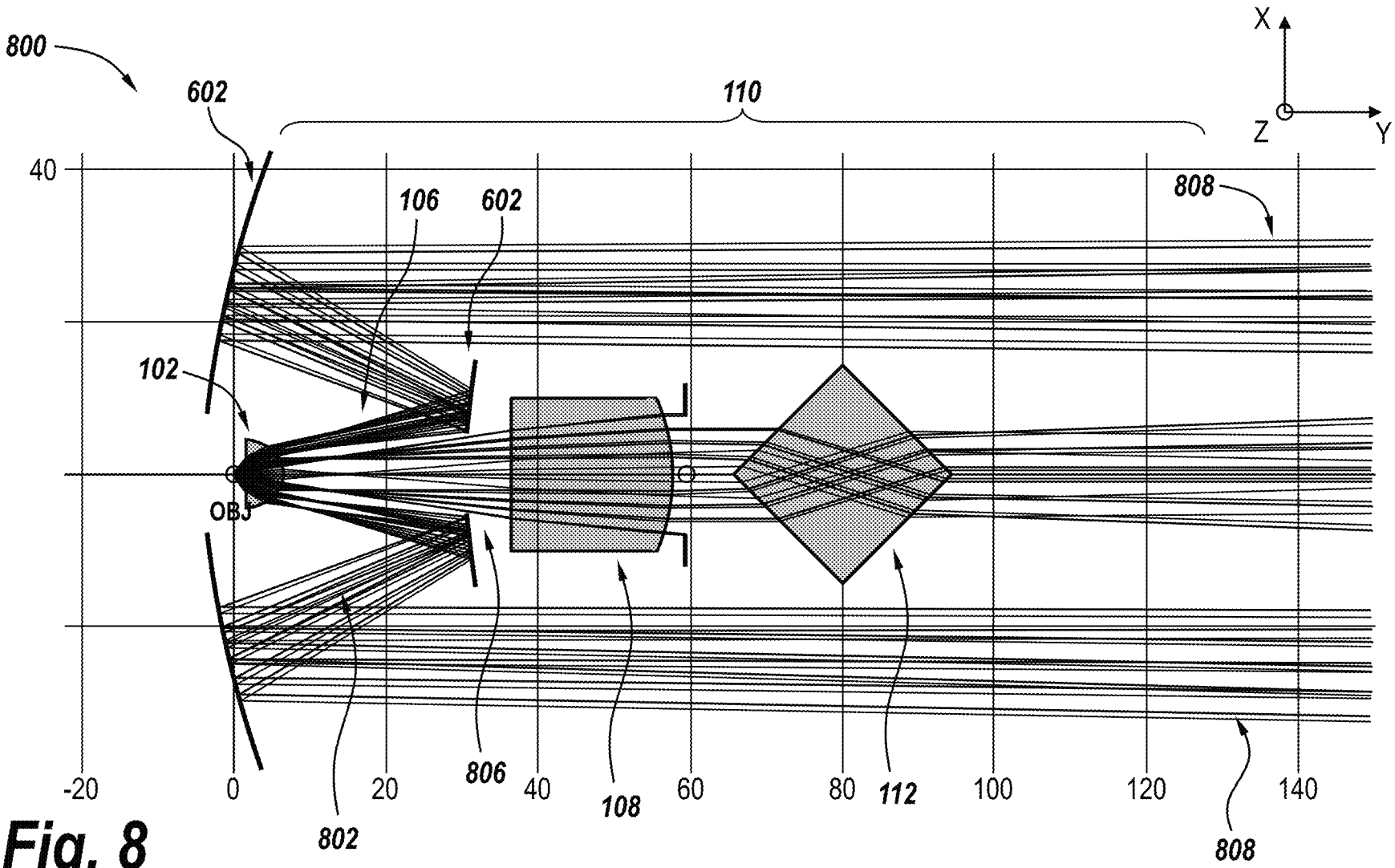
FIG. 8 is an overhead block diagram of an example illumination system using reflective lenses.

FIG. 8 shows another implementation of an illumination system 800 in accordance with the subject technology. It should be understood that the components of the illumination system 800 can function similarly to those of the other illumination systems herein, except as otherwise shown and described herein. Illumination system 800 includes a two reflective mirrors 602 in front of a light source 102 emitting light 106. Reflective mirrors 602 are offset from the boresight of light source 102 in the azimuth plane. Reflective mirrors 602 are situated before the collimating lens 108 along the optical path 110 in contrast to the reflective mirrors 602 situated after the collimating lens 108 in the illumination system shown in FIG. 6. As shown, the two reflective mirrors 602 redirect a portion of the light 106 emitted from the light source 102 into separate, substantially parallel beams 808 along the optical path 110. In this regard, the light 106 is divided between a fixed pattern (low beam) 802 and a central beam 806, the central beam 806 passing through the collimating lens 108 and optical element 112. As mentioned prior, optical element 112 may shift along the azimuth direction, that is, the "x-y" plane, such as in illumination system 100, to redirect the central beam 806 to a target position 116 within a surrounding environment. The optical path in illumination system 800 may enable functions such as a fog lamp projection alongside a spotlight projection.

Figure 9:
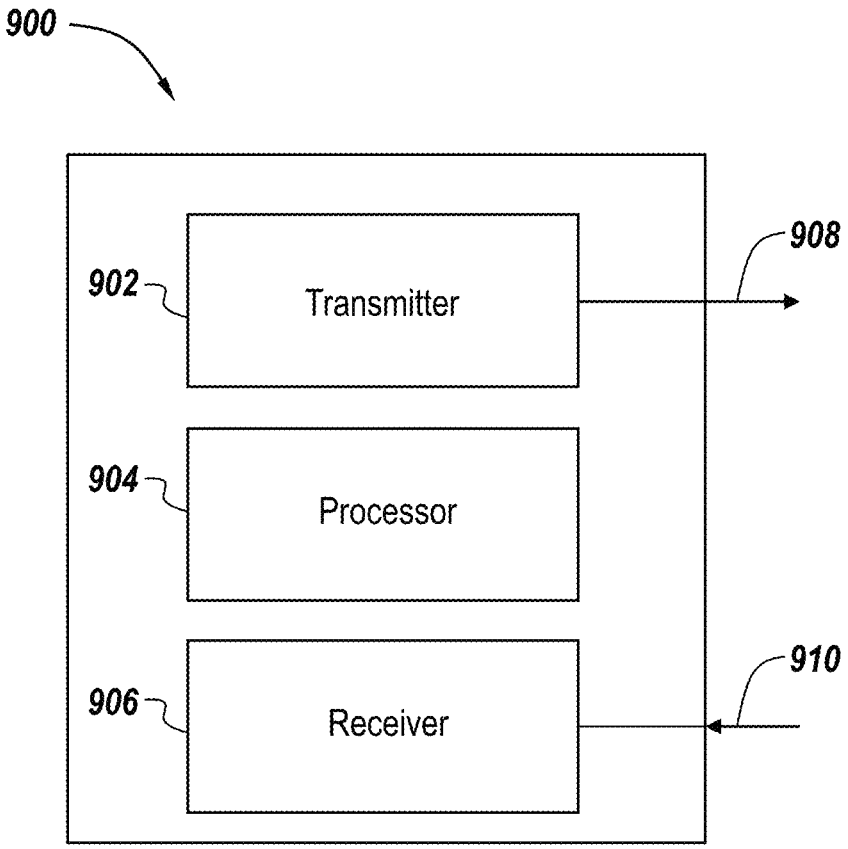
FIG. 9 is a block diagram of an exemplary detection system that, in some implementations, is used in conjunction with the illumination system in accordance with the subject technology.

FIG. 9 is a block diagram of an exemplary detection system 900 that, in some implementations, is used in conjunction with illumination system described herein. Detection system 900 can include multiple sensing modules such as LiDAR, LADAR, radar, camera, radio, GPS, GNSS, map, and other like detection modules. In this regard, detection system 900 may regularly scan the environment for data concerning the environment such as: surface impediments; hazardous or nonhazardous articles thereon; curves or turns in the traveling surface; or markers such as crosswalks or lane dividing lines. The target position 116 may include other articles such as vehicles or signs, and retroreflective surfaces thereon such as a license plate, light modules, or traffic signs. The target position 116 may be another object or characteristic of the environment.

In an exemplary implementation, system 900 includes a laser transmitter 902, a processor 904, and a receiver 906. Laser transmitter 902 is configured to emit laser pulses and/or wavelength-converted pulses 908 while receiver 906 is configured to receive reflected and/or returned laser pulses 910 scattered from a target object and/or terrain. Processor 904 may perform functions such as, without limitation, streaming cross-correlations, artifact corrections, target acquisitions, and tracking and discrimination of targets. Processor 904 may generate image data and/or information for other systems such as an illumination system described herein, or an automatic target recognizer system. Processor 904 may communicate with a processing module 120 on illumination systems described herein to actuate the optical element 112 and/or stage 104 to direct the light 106 emitted from the light source 102 to direct the optical path 110 to a target position in the environment based on data concerning the environment.

In this regard, illumination system systems described herein can selectively target and direct a spotlight in both a vertical and azimuth plane with very few moving parts, both in the day time or night time. As such, illumination systems can automatically direct a light beam emitted by the spotlight at a high illuminance toward an identified target position, thus alerting a driver of an article, impediment, or the like without driver intervention.

It will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. processors, circuitry, and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. An illumination system for a vehicle comprising:

a light source to emit light along an optical path and into an environment;

a lens positioned along the optical path configured to collimate the light to a light beam; and an optical element having a body comprising four sides and a reflective member within the body, the optical element positioned along the optical path and configured to redirect the light beam, the optical element configured to move around an optical element axis to change a direction the light beam is transmitted into the environment, wherein the illumination system is configured to receive a target position within the environment and move the optical element to fixate the light beam onto the target position.

2. The illumination system of claim 1, wherein a rotational position of the optical element around the optical element axis determines an azimuth direction of the light beam.

3. The illumination system of claim 1, wherein the light source is affixed to a stage, the stage configured to move orthogonal to the lens to change a direction the light beam is transmitted into the environment, wherein the illumination system is configured to move the light source to fixate the light beam onto the target position.

4. The illumination system of claim 1, wherein the light source includes a high irradiance white light source.

5. The illumination system of claim 1, further comprising a detection system configured to determine the target position within the environment.

6. The illumination system of claim 1, wherein the reflective member within the body comprises glass or an optical polymer.

7. The illumination system of claim 1, wherein the reflective member includes a reflective surface configured to interface with the light beam.

8. The illumination system of claim 1, wherein the reflective member forms a diagonal cross section of the optical element such that the reflective member forms an isosceles right triangular prism with two of the four sides.

9. A vehicle spotlight comprising:

a spotlight housing having a transmissive side;

a light source positioned within the spotlight housing, the light source configured to emit a light beam along an optical path and into an environment;

a lens positioned within the spotlight housing between the light source and the transmissive side, the lens positioned along the optical path, the lens configured to receive the light beam from the light source and collimate the light; and an optical element positioned within the spotlight housing between the lens and the transmissive side, the optical element positioned along the optical path, the optical element having a body comprising four sides and a reflective member within the body, the optical element configured to move around an optical element axis to change a direction the light beam is transmitted through the transmissive side of the spotlight housing and into the environment, wherein the vehicle spotlight is configured to receive a target position within the environment and move the optical element to fixate the light beam onto the target position.

10. The vehicle spotlight of claim 9, wherein a rotational position of the optical element around the optical element axis determines an azimuth direction of the light beam.

11. The vehicle spotlight of claim 9, wherein the light source is affixed to a stage, the stage configured to move orthogonal to the lens to change a direction the light beam is transmitted into the environment, wherein the vehicle spotlight is configured to move the light source to fixate the light beam onto the target position.

12. The vehicle spotlight of claim 9, further comprising a detection system configured to determine the target position within the environment.

13. A method of illuminating a target position within an environment comprising:

receiving, with an illumination system, data related to a target position within the environment;

emitting light, with a light source of the illumination system, along an optical path and into the environment;

collimating, with a lens of the illumination system, the light from the light source into a light beam;

providing, by the illumination system, the light beam to an optical element of the illumination system, the optical element having a body comprising four sides and a reflective member within the body;

actuating the optical element around an optical element axis to change a direction the light beam is transmitted into the environment based on the received target position within the environment.

14. The method of claim 13, wherein a rotational position of the optical element around the optical element axis determines an azimuth direction of the light beam.

15. The method of claim 13, further comprising:

affixing the light source to a stage, the stage configured to move orthogonal to the lens; and moving the stage to shift a position of the light source relative the lens to change a direction the light beam is transmitted into the environment.

16. The method of claim 13, wherein the light source includes a high irradiance white light source.

17. The method of claim 13, further comprising generating data related to a target position within the environment using a sensor system including one or more of the following: LiDAR, LADAR, radar, camera, radio, GPS, GNSS, or map.

18. The method of claim 13, wherein the reflective member within the body comprises glass or an optical polymer.

19. The method of claim 13, wherein the reflective member includes a reflective surface configured to interface with the light beam.

20. The method of claim 13, wherein the reflective member forms a diagonal cross section of the optical element such that the reflective member forms an isosceles right triangular prism with two of the four sides.

* * * * *